United States Patent [19]

Abrams

[11] 4,381,720

[45] May 3, 1983

[54] FABRIC ORIENTATING MECHANISM COOPERATING WITH A SEWING MACHINE

[75] Inventor: Jack S. Abrams, Northbrook, Ill.

[73] Assignee: Union Special Corporation, Chicago, Ill.

[21] Appl. No.: 303,650

[22] Filed: Sep. 18, 1981

[51] Int. Cl.[3] ..... D05B 21/00

[52] U.S. Cl. ..... 112/121.15; 112/65; 112/308

[58] Field of Search ..... 112/121.15, 121.11, 112/121.12, 65, 308, 309

[56] References Cited

U.S. PATENT DOCUMENTS

| | | | |
|---|---|---|---|
| 3,082,719 | 3/1963 | Zeitlin | 112/65 |
| 3,294,393 | 12/1965 | Adams et al. | 112/308 X |
| 3,323,476 | 6/1967 | Kass | 112/65 |
| 3,329,109 | 7/1967 | Portnoff et al. | 112/308 X |
| 3,349,732 | 10/1967 | Perrella et al. | 112/65 |
| 3,611,819 | 10/1971 | Muller et al. | 112/121.15 X |
| 3,734,038 | 5/1973 | Taketomi | 112/121.15 |
| 3,742,879 | 7/1973 | Schaefer, Jr. et al. | 112/121.12 |
| 3,970,016 | 7/1976 | Yanikoski | 112/121.12 |
| 4,114,545 | 9/1978 | Manabe et al. | 112/121.15 |
| 4,186,673 | 2/1980 | Vartoukian | 112/121.15 |
| 4,217,838 | 8/1980 | Portilla, Sr. | 112/121.12 |
| 4,297,955 | 11/1981 | Shaw | 112/308 X |

*Primary Examiner*—H. Hampton Hunter

*Attorney, Agent, or Firm*—John W. Harbst; John A. Schaerli

[57] ABSTRACT

Two carriage systems, X and Y, are provided with the X carriage system being carried by the Y carriage system. Each system includes a carriage which via two sets of rollers is capable of movement along a guide rail set. Flex hinges are provided in each carriage to seat the rollers in the guide rails. The hinges are generally rigid in a first plane and flexible in a second such that the carriage is stiff yet the distance between the rollers can vary to compensate for absolute distance changes in the rails, due, for example, to high or low spots in the roller contacting surface.

7 Claims, 10 Drawing Figures

FABRIC ORIENTATING MECHANISM COOPERATING WITH A SEWING MACHINE

BACKGROUND OF THE INVENTION

The present invention relates to automated sewing machines, and particularly to an X-Y fabric orientating mechanism.

Both automatic and semi-automatic sewing machine systems for performing predetermined stitch patterns on fabric pieces are well known in the prior art. Basically, these systems employ an industrial sewing machine, a microprocessor or equivalent control device and an orientating mechanism for moving the fabric under the needle of the sewing machine in response to commands from the control device.

The orientating mechanism in some of these systems secures the fabric piece and moves it in a two dimensional orthogonal field. Competition has dictated that speeds of 1800 or more stitches per minute must be attained and at the same time maintain a high stitch quality. That is, all stitches are the same length as predetermined, they are formed in the proper manner, etc.

In order to satisfy these demands, various steps are taken. The two dimensional orientating mechanism is actuated by means of stepper motors operative when the needle is withdrawn from the material so as to incrementally step the fabric between stitching cycles. That is, the fabric piece is generally stationary from the time the needle enters it until it is withdrawn. Cables or like flexible means are used to connect the frame mounted stepper motors to the separate X and Y carriages. Structural rigidity and low inertia forces are the objectives to be achieved.

But, as the demand to sew larger and larger fabric pieces increases, so do the problems with designing and manufacturing a stucturally rigid system which has a low inertia.

SUMMARY OF THE INVENTION

The invention of interest is directed to a machine for sewing flexible material including an industrial sewing machine, a clamp device for actually holding the fabric, a carriage assembly carrying the clamp, and a microprocessor device which controls the actions of various elements. The carriage assembly comprises first and second carriage systems which in turn are made up of first and second carriages each with its own set of guide rail means. One of the carriages being designed to move in the X direction and the other in the Y direction. In a preferred embodiment, the X or first direction carriage is carried by the Y or second direction carriage. Sets of roller means are employed by each carriage to allow movement along the guide rails. Herein lies a problem, since the rollers must always generally contact the guide rails with about the same pressure thus taking into consideration the manufacturing technology of fabricating and assembling a set of rails, the distance between them at any given point may vary by no more than $\pm 0.002$. The solution is in loading the rollers against the rails to compensate for manufacturing and assembly errors. The device which accomplishes this is to be of low weight and simultaneously flexible and rigid.

In practice, both the first and second carriage means are urged against their respective rail system in the same manner. Therefore, explanation will be limited to the first or X carriage with the understanding that it applies to the Y or second carriage as well. The X carriage includes a first and second frame portion, each of which carries a set of rollers. Thus, the two sets of rollers can move with respect to each other. A set of loading and compensating means maintain the frame means such that they can move in this generally telescoping manner. Associated with the loading and compensating means are first and second flexible hinge means. By orientating and fixing them with their long dimension in the vertical plane, they become generally rigid in that plane. In the horizontal plane across their short dimension, however, they retain the required degree of flex to maintain the roller/guide rail relationship. The tandem set of flexible hinge means are attached to one of the frame portion means in a spaced apart relationship. The loading and compensating means which then carry the other frame portion extend between the flex hinge means such that they can exert force on them to bend them one way or the other independently or together in the horizontal plane.

Therefore, it is an object of this invention to provide a microprocessor controlled sewing machine associated with a fabric orientating means which has low inertia and high structural rigidity. Yet, another object of this invention is to provide a fabric orientating means which employs flexible hinge means to maintain the roller means in contact with the guide rail. Still another object of this invention is to provide fabric orientating means that includes first and second carriage means that are kept in contact with guide rail means by flexible hinge means which are orientated such that they are very rigid in a first plane and generally flexible in a second plane. But, another object of this invention is to provide a means for urging roller sets against guide rail sets which are flexible during operation to compensate for variances in absolute distance between the guide rail sets without reducing rigidity. Another object of this invention is to provide a flex hinge means for maintaining a first and second roller in contact with a first guide rail and a third and fourth roller in contact with a second guide rail such that at the same time the first and third rollers can move toward each other while the second and fourth roller move away from each other or vice versa.

Other features of the invention will be made apparent from the following detailed description of the preferred embodiment thereof, with certain variations therefrom being suggested.

The preferred embodiment of the invention, and certain variations, are shown in the accompanying drawings.

DESCRIPTION OF THE PREFERRED EMBODIMENT

Figure 1:
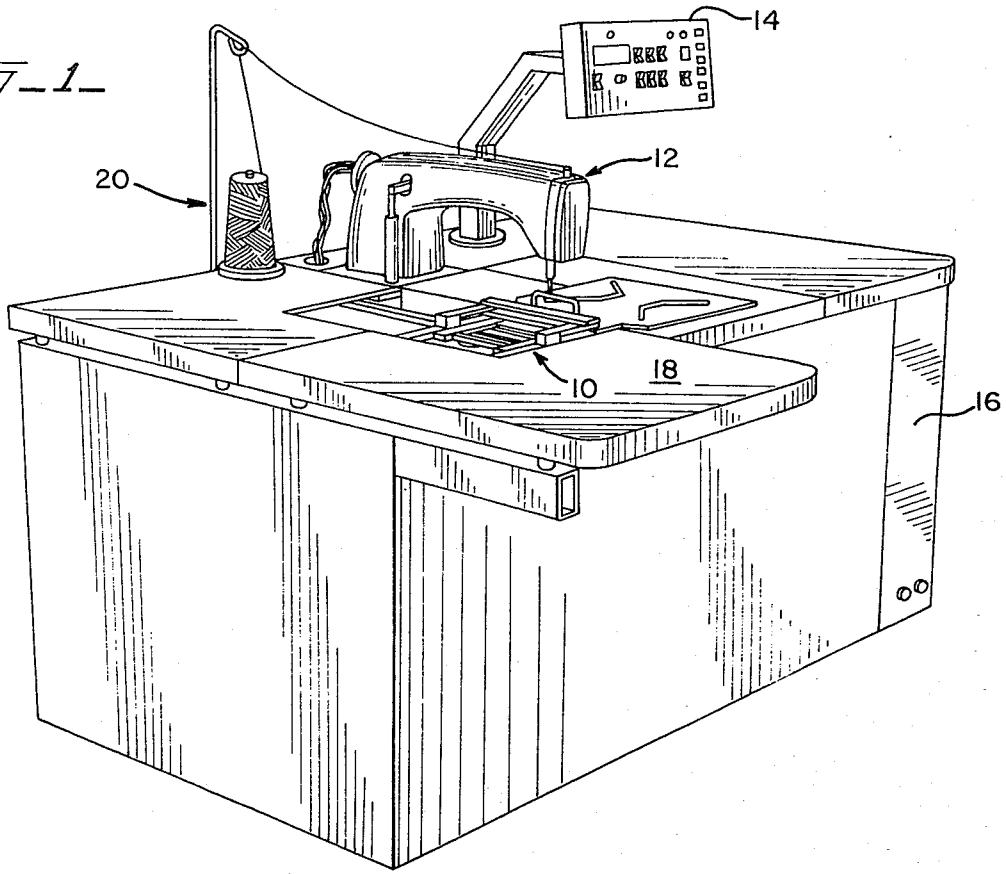
FIG. 1 is a perspective view of the sewing machine, microprocessor and fabric orientating mechanism.
Figure 2:
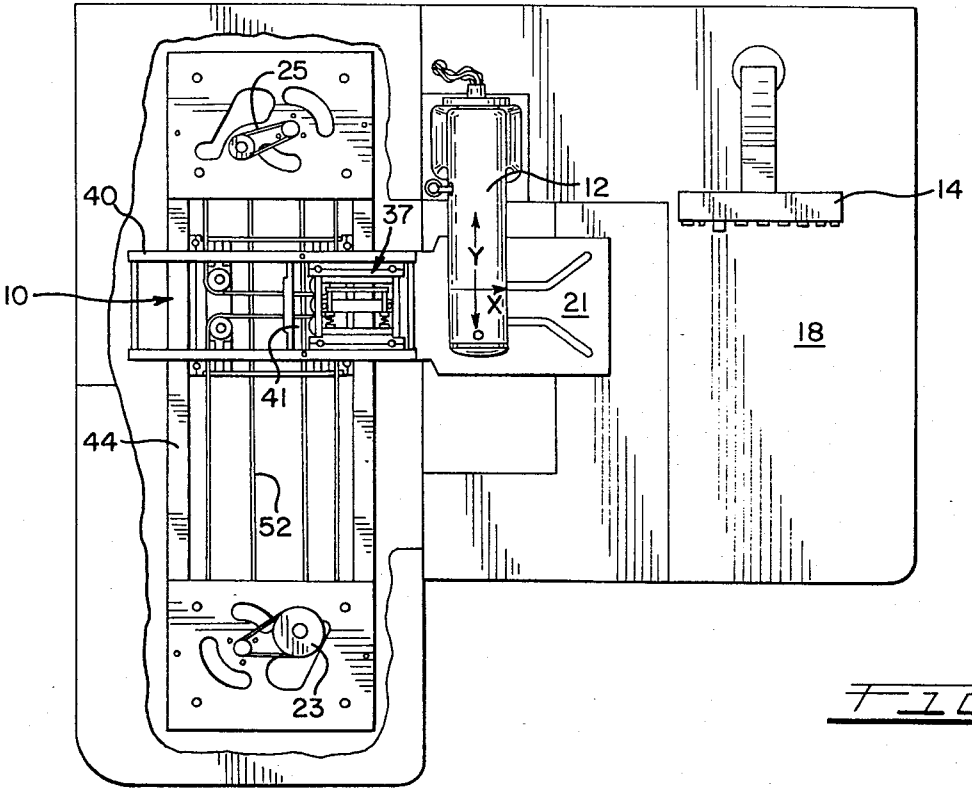
FIG. 2 is a top plan view of FIG. 1, partially broken away, showing the carriage assembly means according to the instant invention.

Referring to FIGS. 1 and 2 wherein is illustrated the carriage assembly means 10 of the present invention in combination with an industrial sewing machine means 12, a microprocessor assembly means which includes the control panel means 14 and the electronic and related hardware means 16 (not shown). As shown in FIG. 1, tabling means 18 and thread stand means 20 can be considered conventional in the industry.

Turning to FIG. 2, the carriage assembly means 10 is seen to comprise a first carriage system means 37 which includes the first set of enveloping guide rail means 40, and a second carriage system means 41 which includes a second set of enveloping guide rail means 44. A fabric clamp means 21 is shown secured to the carriage assembly means 10 for holding the fabric material during the work cycle. Mounted to and carried by the total machine frame are the driving system motor means 23 and 25 which during a work cycle via the cable system means 52 (only partially shown) cause the carriage system means 10 to move the fabric material (not shown) such that the desired stitch pattern is created.

Figure 3:
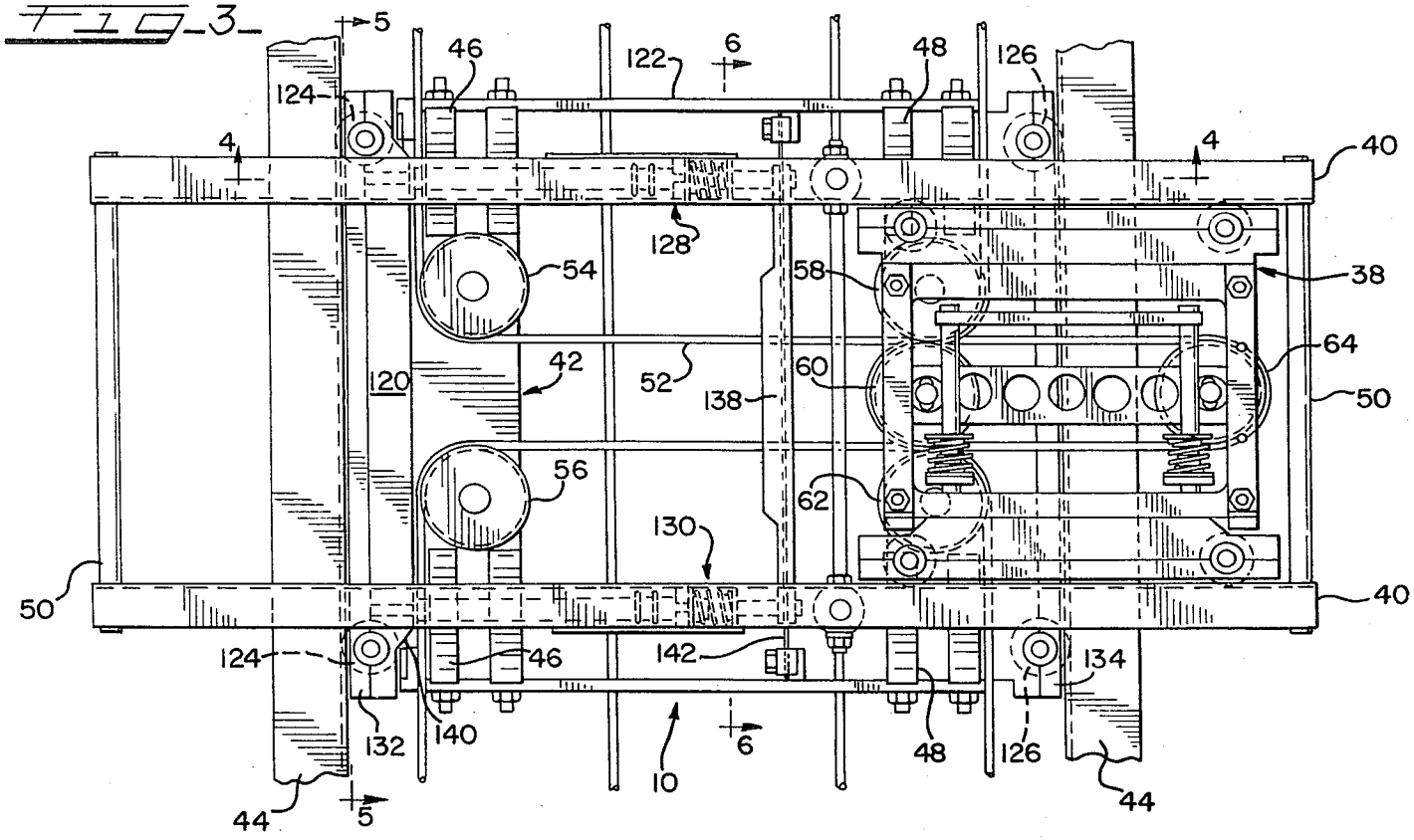
FIG. 3 is a top plan view of the two carriage system means with portions of the guiding rails broken away.
Figure 4:
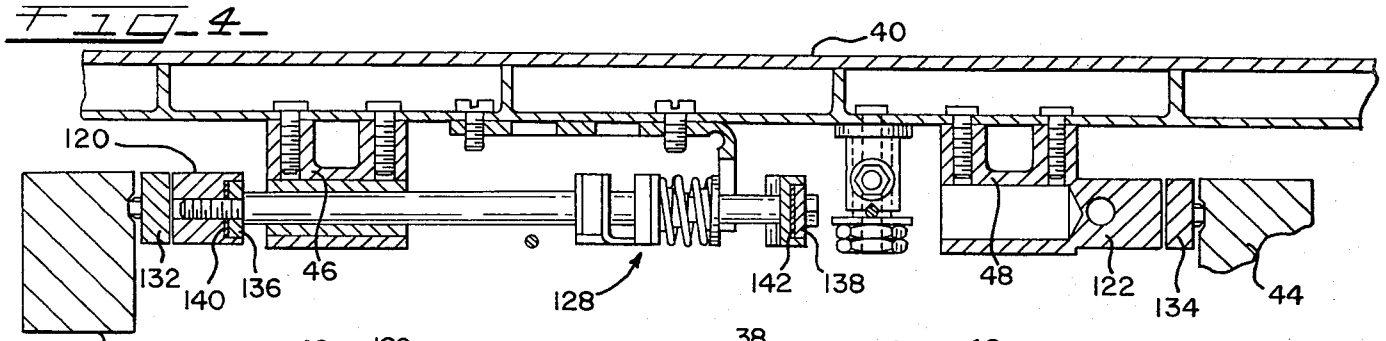
FIG. 4 is an enlarged, sectional view taken on the vertical plane indicated by the line 4—4 in FIG. 3.

Referring now to FIGS. 3 through 6 wherein is partially shown the carriage system means 10 which imparts to the fabric clamping means the desired movement along the X—X and Y—Y axis. The first carriage system means 37 includes a carriage means 38 which cooperates with the first set of enveloping guide rail means 40 to contribute the desired movement along the X—X axis. The second carriage system means 41 includes a second carriage means 42 which cooperates with the second set of enveloping guide rail means 44 to contribute the desired movement along the Y—Y axis. The first carriage means 38 and the first set of enveloping guide rail means 40 are secured to and carried by the second carriage means 42 via first and second bridge means 46 and 48 as shown in FIGS. 3 and 4. The first sets of enveloping guide rail means 40 are provided with rail tension means 50 (only set associated with guide rail means 40 is shown) which maintain the associated rail means in an exact predetermined position. Portions of the cable or flexible system means 52 is shown associated with various sheave means 54 through 64.

For purposes of the invention hereunder consideration, the first carriage system means 37 which includes first set of enveloping guide rail means 40 is generally the same as the second carriage means 41 which includes second set of enveloping guide rail means 44. Therefore, for the sake of simplicity, a discussion of the first carriage system 37 and related elements will be made. Reference should thus be made to FIGS. 7–10.

The first carriage means 38 includes; a second frame means 66, a first or flating frame means 68, a first bearing or roller set means 70, a second bearing or roller set means 72, first and second loading and compensating means 74 and 76 which in the preferred embodiment are both thrust spring mandrel means; first and second frame cap means 78 and 80, first and second stabilizing means 82 and 84, and first and second flex hinge means 86 and 88 which in a preferred embodiment are flat spring steel members. The first roller set means 70 includes first roller 71, second roller 73, and second roller set means 72 includes third roller 73 and fourth roller 75.

Figure 7:
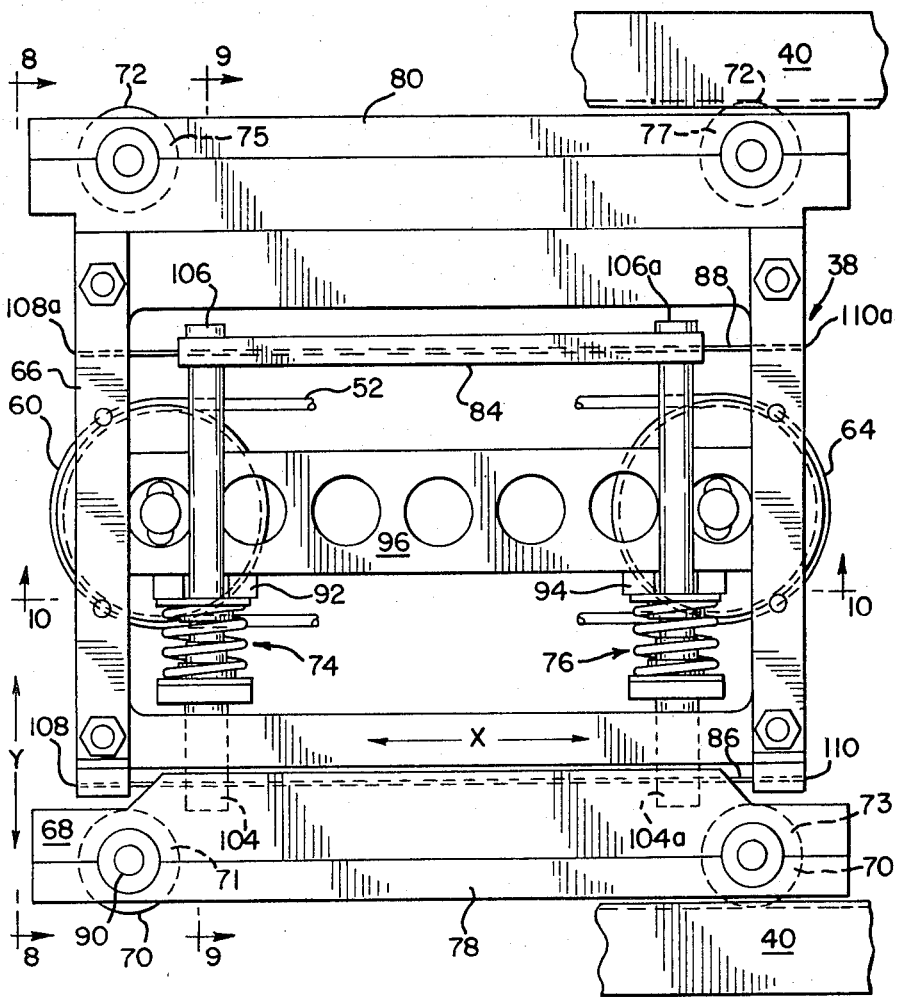
FIG. 7 is a top plan view of the first, carried or X direction carriage system means with portions of the guiding rails broken away.
Figure 8:
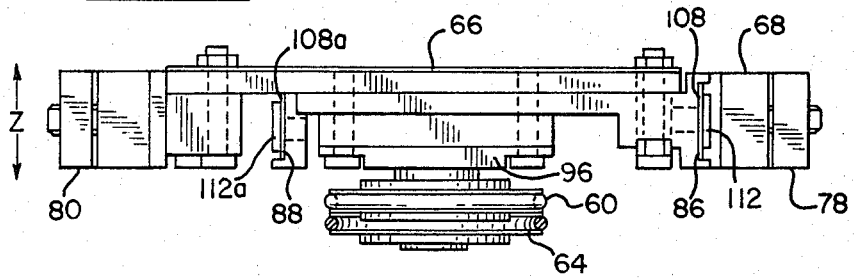
FIG. 8 is a view taken on the vertical plane indicated by the line 8—8 in FIG. 7.
Figure 9:
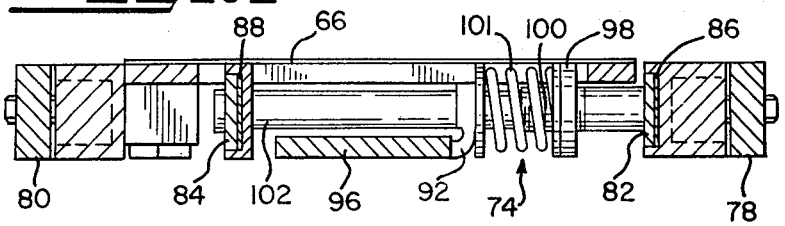
FIG. 9 is a sectional view taken on the vertical plane indicated by the line 9—9 in FIG. 7.
Figure 10:
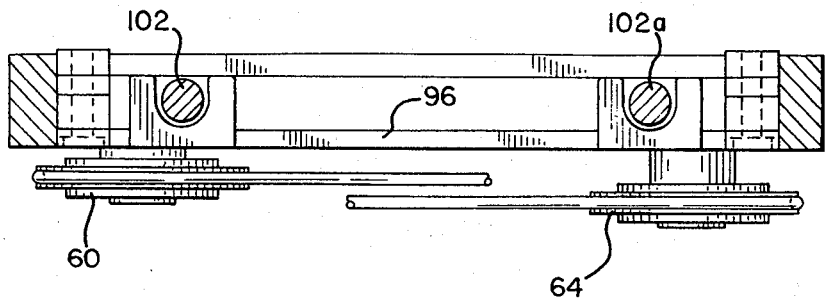
FIG. 10 is a sectional view taken on the vertical plane indicated by the line 10—10 in FIG. 7.

As shown in FIGS. 7, 8 and 9, the frame cap means are secured by any suitable means to the respective frame means 68 or 70 providing seat means such as 90 for the roller set means.

The first carriage means 38 as shown in FIG. 7 has a first major plane which is parallel with that of the sheet and a second which is perpendicular thereto. The first and second thrust spring mandrel means 74 and 76 are individually secured to the first frame means 66 via bracket means 92 and 94 which are attached by a horizontally extending member means 96, that also serves to carry the sheave means 60 and 64. Both said thrust spring mandrel means are substantially identical. Thus, discussion will be limited to said first means 74 with the understanding that it applies to said second means 76. The loading and compensating or thrust spring mandrel means 74 is employed as a conduit for force from said first frame means 66 to said first and second flex hinge means 86 and 88 and includes a nut means 98, a threaded portion means 100, a spring means 101, and a horizontally extending rod means 102.

Both the first and second thrust spring mandrel means 74 and 76 have first and second end means 104 and 104*a*, 106 and 106*a*. The first end means 104 and 104*a* are secured to the first flexible hinge means 86, the second end means 106 and 106*a* being secured to the second flexible hinge means 88. In a preferred embodiment stabilizing bar means 82 and 94 are secured over a length of the respective flex hinge means 86 or 88. The stabilizing bar means in a preferred embodiment is two elongated portions which are fixed to the flex hinge means in a sandwich like fashion. The purpose being as their name denotes is to contribute stability to the flexible hinge means. The first and second flex hinge means 86 and 88 each have first and second end means 108 and 108*a*, and 110 and 110*a*. As shown in FIG. 8, the first and second end means 108 and 108*a* are secured to the first frame means 66 by a threaded screw means shown as 112 and 112*a*. The first and second end means 110 and 110*a* are secured in essentially the same manner. Thus, when force is delivered from the first frame means 66 via the thrust spring mandrel means 74 and 76 to the stabilizing bar means 82 and 84, the flex hinge means will bend or bow, either toward the top of the sheet of FIG. 7 or toward the bottom. As should be understood, the portions of the flex being means 86 and 88 at the left side of FIG. 7 in response to force from first and third roller means 71 and 75 may bend toward the top of the sheet while those portions at the right, in response to force from second and fourth roller means 73 and 77, are bending toward the bottom of the sheet. The reverse situation can also occur. The two flex hinge means as shown in FIG. 7 have their long dimension running from the left of the sheet to the right, which will be called the X axis. The dimension which extends from the top to the bottom of the sheet, the "Y" axis, and the dimension which extends into and out of the sheet, the "Z" axis (see FIG. 8). These flex hinge means have very substantial rigidity against forces exerted in the Z axis. That is, forces perpendicular to the major plane of the first frame means 66. They are rather flexible, however, in reacting against forces exerted along the "Y" axis or parallel with the major plane of the first frame means 66.

Secured to the ends 104 and 104*a* of the first and second thrust spring mandrel means 74 and 76 is the second or floating frame means 68. As previously stated, the roller set means 70 is carried thereby. Thus, as the flex hinge means 86 and 88 "bow" toward the top of FIG. 7, the absolute distance between the first roller set means 70 and second roller set means 72 will become less. When they bow toward the bottom of FIG. 7, the absolute distance between the two sets will become greater. As previously stated, combinations of these states may simultaneously exist.

In practice, the loading and compensating means 74 and 76, via the frame means 66 exert a predetermined force against the roller sets such that they seat with their corresponding guide rail means to ensure proper performance. However, as previously stated, due to fabrication or manufacturing problems, the absolute distance between the roller means engaging surfaces such as 109 and 109*a* in FIG. 5, of the guide rail means will not be the same over the entire length. It has been determined that slack introduced into the first and second carriage system means 37 and 41 from such a source destroys their ability to perform the functions for which they were designed.

As should be appreciated, because of the flexibility of the flex hinge means 86 and 88 in the "Y" axis, the portions adjacent end means 108 and 108*a* can bow toward the top of FIG. 7 while the portions adjacent end means 110 and 110*a* can bow toward the bottom of FIG. 7. Thus, problems are avoided should the roller engaging surface of the guide rail means have various high and low points over the length of the guide rail.

Figure 5:
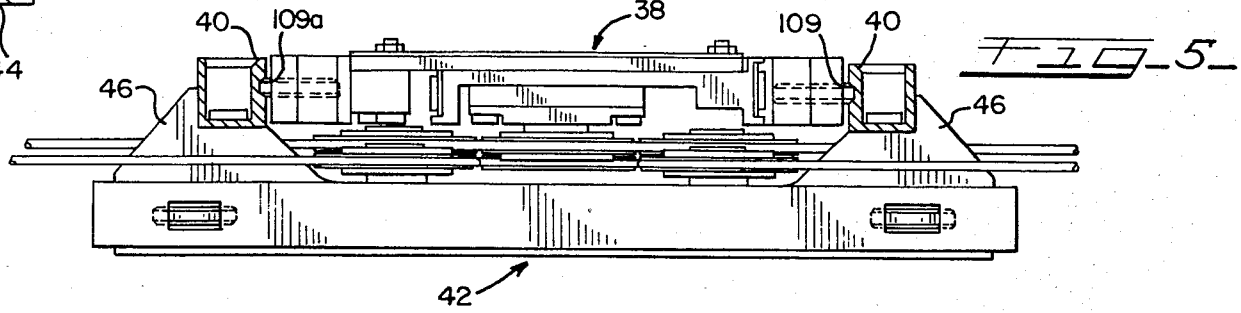
FIG. 5 is an enlarged, sectional view taken on the vertical plane indicated by the line 5—5 in FIG. 3.
Figure 6:
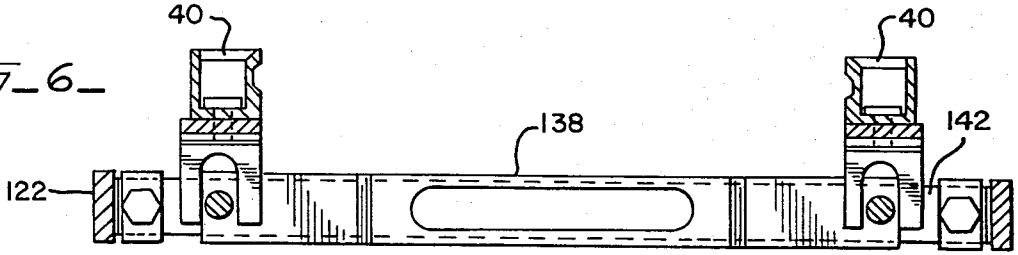
FIG. 6 is an enlarged, sectional view taken on the vertical plane indicated by the line 6—6 in FIG. 3.

As stated, the first carriage system means 37 including the first set of guide rail means 40 via the bridge means 46 and 48 is fixedly carried by the second carriage system means 41 as shown in FIGS. 3, 4 and 5. For the purposes of the invention hereunder consideration, the second carriage system means 41 can be considered structurally and functionally the same as first carriage system means 37. Thus, second carriage system means 41 along with the previously mentioned rail means includes; a first or flating frame means 120, a second frame means 122, a first and second set of roller means 124 and 126, first and second loading and compensating means 128 and 130 which in the preferred embodiment are both thrust spring mandrel means, first and second frame cap means 132 and 134, first and second stabilizing bar means 136 and 138, and first and second flex hinge means 140 and 142 which in a preferred embodiment are flat spring steel members.

In summation, there is thus provided a machine for sewing flexible material which includes a sewing machine, a clamp for securing the flexible material, a carriage assembly that carrying the clamp and a microprocessor system for directing the action of the carriage assembly and sewing machine such that the predetermined sewing operation is performed. The carriage assembly includes first and second guide rail sets disposed at right angles to each other in spaced apart parallel planes and first and second carriage means. The first carriage means is associated with the first guide rail set, both of which in turn are carried by said second carriage which is associated with said second guide rail set means. First and second sets of rollers secured to said first carriage and engage the first guide rail sets whereby said first carriage can move therealong. A first and second flex hinge is associated with the first and second set of rollers such that the sets of rollers are urged against the first guide rail set in a single plane and can move apart with respect to each other. Additionally, third and fourth sets of rollers are secured to the second carriage, engaging the second guide rail set whereby the carriage means can move therealong. A third and fourth flex hinge are associated with the third and fourth sets of rollers whereby these sets of rollers are urged against the guide rails in a single flat plane and can move in this plane with respect to each other.

While various embodiments of the invention have been disclosed in the foregoing, it should be understood that these are simply illustrative of the novel features of the invention, and other forms of certain aspects of the invention may be utilized within the scope of the claims hereinafter presented.

What is claimed is:

1. A carriage system means including:

first and second set of roller means;

a first frame means, having a major plane, carrying said first set of roller means;

first and second flex hinge means each having a major plane generally perpendicular to the major plane of said frame means, each of said first and second flex hinge means having end means, said end means being secured to said first frame means;

first and second loading and compensating means disposed between said first and second flex hinge means each having a line of action generally parallel with the major plane of said first frame means; and a second frame means carrying said second set of roller means and being secured to said second flex hinge means whereby the location of said first set of roller means can vary with respect to said second set of roller means.

2. A carriage means cooperating with a pair of guide rail means that has first and second frame means which are movable with respect to each other and each having a common major plane, a first bearing set means carried by said first frame means and a second bearing set means carried by said second frame means, said first and second bearing set means mating with said pair of guide rail means, wherein the improvement comprises: generally unidirectional first and second flex hinge means each having major and minor planes as well as first and second end means, said first and second end means of both said first and second flex hinge means being secured to said first frame means, said major plane of both said first and second flex hinge means being generally perpendicular to that of said major plane of said first frame means;

means mounting said second frame means to said second flex hinge means whereby said second frame means may move in said common major plane with respect to said first frame means; and first and second stabilizing bar means, said first stabilizing bar means being carried by said first flex hinge means in a generally sandwich fashion, said second stabilizing means being carried by said second flex hinge means in a generally sandwich fashion.

3. The carriage means of claim 2 wherein said means mounting said second frame means includes:

first and second laterally extending member means each having first and second end means, both of said first end means being generally secured to said first flex hinge means; and means whereby both of said second end means of said first and second laterally extending member means and said second frame means are secured generally to said second flex hinge means.

4. The carriage means of claim 3 including: means secured to said first frame means whereby force can be transferred to said first and second flex hinge means to cause bending in a plane generally perpendicular to said major plane of said first and second flex hinge means.

5. The carriage means of claim 4 wherein said means secured to said first frame means includes:

a bracket means secured to said first frame means;

first and second frame means for transferring force to said first and second flex hinge means which includes; nut means, threaded portion means and spring means cooperating with a first and second laterally extending rod means and said bracket means whereby force can be transferred from said first and second laterally extending rod means and said bracket means whereby force can be transferred from said first frame means to said first and second flex hinge means.

6. The carriage means of claim 5 wherein stabilizing bar means are secured to said flex hinge means in a generally sandwich like fashion, and the first and second end means of each first and second laterally extending member means are secured thereto.

7. A machine for sewing flexible material including a sewing machine means, a clamp means for securing said flexible material, a carriage assembly means carrying said clamp means and a microprocessor means for directing the action of the carriage assembly means and sewing machine means to perform the predetermined sewing operation, said carriage assembly means comprising:

first and second guide rail set means disposed at right angles to each other in spaced apart parallel planes;

first and second carriage means, said first carriage means being associated with said first guide rail set means, both of which are carried by said second carriage means which is associated with said second guide rail set means;

first and second set of roller means secured to said first carriage means, engaging said first guide rail set means whereby said first carriage means can move therealong;

first and second flex hinge means associated with said first and second set of roller means whereby said set of roller means are urged against said guide rail means in a single plane and can move with respect to each other;

third and fourth set of roller means secured to said second carriage means, engaging said second guide rail means whereby said carriage means can move therealong; and third and fourth flex hinge means associated with said third and fourth set of roller means whereby said set of roller means are urged against said guide rail means in a single plane and can move with respect to each other.

* * * * *